United States Patent [19]

Tramier

[11] 4,063,386

[45] Dec. 20, 1977

[54] RESTORATION OF DRILLING MUD-PITS

[75] Inventor: Bernard Tramier, Pau, France

[73] Assignee: Societe Nationale Elf Aquitaine (Prod.), Paris, France

[21] Appl. No.: 753,701

[22] Filed: Dec. 23, 1976

[30] Foreign Application Priority Data

Dec. 30, 1975 France ..... 75.40070

[51] Int. Cl.[2] ..... E02D 3/14

[52] U.S. Cl. ..... 47/58; 47/DIG. 10; 61/35

[58] Field of Search ..... 61/35, 36 R; 47/1, 58, 47/DIG. 10

[56] References Cited

U.S. PATENT DOCUMENTS

| | | | |
|---|---|---|---|
| 3,797,250 | 3/1974 | Canevari | 61/35 X |
| 3,920,795 | 11/1975 | Selmeczi et al. | 61/35 X |
| 3,996,696 | 12/1976 | Davidtz | 47/58 |

*Primary Examiner*—Robert E. Bagwill

*Attorney, Agent, or Firm*—Ostrolenk, Faber, Gerb & Soffen

[57] ABSTRACT

Restoration of drilling mud-pits which have served for purification treatment of drilling effluents in the search for hydrocarbons on terra firma by covering the floc of the mud-pit with a layer of water-absorbent material, particularly a natural cellulosic material, before filling the hollow or basin in with earth. The process makes it possible to firmly stabilize the refilled ground and make it cultivatable; it represents a substantial economy over known methods.

14 Claims, No Drawings

RESTORATION OF DRILLING MUD-PITS

The invention relates to the restoration of drilling mud-pits, that is, the refilling of hollows or basins which have served for the purification treatment of drilling effluents in the search for hydrocarbons on terra firma. It envisages, more particularly, a method of such refilling with a view to making the ground in the place where such an effluent treatment basin was located available for any normal use.

When a basin, dug in the ground, has served for the purification of drilling liquids, it contains a muddy deposit, known as "floc". When the drilling is terminated, the basin with its floc constitutes a mud-pit that cannot be left as is in an inhabited region; this mud-pit, as a matter of fact, presents the danger of swallowing up people and animals because of its rheological properties, making it comparable to quicksand. It is therefore necessary to fill the hole, but the filling with earth, although it fills up the cavity, does not eliminate the danger of being swallowed up because the floc makes the fill earth soft and viscous and difficult to dry.

The known means that can be used for the elimination of such mud-pits are more or less difficult and expensive to carry out. Such is the case of the conveyance of the deposits of floc to a treatment station; the same is true of operations of solidification and those of incineration.

The present invention provides a practical and effective solution to the problem of the restoration of drilling mud-pits. It makes it possible to fill these dangerous basins in such a way as to give back to the resulting ground all of its normal solidity and its cultivation capacity. The invention also makes for a substantial saving since the means that it uses leads to costs about 4 to 15 times less than those of the conventional operations mentioned above.

The new process according to the invention consists in covering the floc in the mud-pit with a layer of material that is absorbent with respect to water, permeable, and lighter than the floc, and then covering this layer with earth. Since this absorbent material serves to pick-up the water from the floc and to allow the water to gradually pass off into the layer of earth, no product capable of interfering with such passage should be interposed between the absorbent material and the earth covering it.

Preferably, the absorbent material selected is biodegradable and favorable to the development of plants. It should insure good stability of the soil after filling.

Absorbent materials capable of doing a good job of fulfilling the function according to the invention are, in particular, natural cellulosic materials which are easy to procure, especially sawdust and wood chips, straw and other grain refuse, for example, corn cobs, leaves and stalks, cork, peat, bark, waste recovered from paper factories, etc. Other residual, hence inexpensive materials can be used as well, such as chips of foam of polyurethane, polystyrene, polyethylene, polypropylene or other polymers, waste of various textiles, old newsprint, etc.

The cellulose, in the form of sawdust, is particularly suitable.

The quantity of absorbent material to be used according to the invention, depends on the water absorption power of this material, and on the nature of the floc to be treated. For wood cellulose, good results are generally obtained with about 0.1 to 0.5 kg of dry cellulose per kg of water to be eliminated from the mud-pit.

Although the deposits, known as flocs have compositions differing from one case to the next, that is, from one drilling operation to the next, they have, in general, the following characteristics in common. They all contain water in a proportion of about 80 to 90%, fill coming from the various terrains encountered in the course of the drilling, especially sediments, sands, clay and lime, and, generally speaking, also the various drilling additives, such as bentonite, carboxy-methyl-cellulose, lignosulphonates, biopolymers (polysaccharides) and sulphates of Na, Ca, Ba. They can also contain biodegradable hydrocarbons. These materials are not only harmless to plants, but can even constitute useful fertilizers. Thus, for example, in a certain number of flocs, amenable to the process of the invention, about 3 to 5% carbon in the form of organic materials, 0.01 to 0.08% total nitrogen and 0.012 to 0.05% assimilable phosphorus expressed in $P_2O_5$ have been found.

It should be noted, moreover, that—in such flocs—have been found about 11 to 17% total lime expressed in $CaCo_3$, a part of it present in the form of $Ca(OH)_2$, a $Mg(OH)_2$ content of 0.05 to 1%, that of KOH, 0.006 to 0.05%, and that of NaOH, 0.01 to 0.26%. The pH of these flocs varied between 7 and 9.3.

In the non-limiting examples which follow, results of experiments carried out in metal drums of 207 liters with a height of 88 cm are given. At the bottom of each drum was placed a layer of floc, which was then covered with a layer of absorbent material; the latter was in turn covered with earth.

After filling, the drums were left in the open air, and the consistency of the earth at the surface was observed; the settlement, that is, the drop in the surface level which took place in time was noted.

In the following examples, the thickness and the settlement figures are given in centimeters.

In the course of the fourth week of the tests, in examples 1 to 11, heavy rain fell, and this should be taken into account in the results found. Since the experimental drums did not have the drainage means existing in nature, a softening of the earth occurred in certain cases, while the consistency of the earth was sometimes perfect after 3 weeks.

EXAMPLES 1 to 4

The absorbent material was constituted by sawdust. The following are the specifications of these experiments.

| No. | 1 | 2 | 3 | 4 |
|---|---|---|---|---|
| Thickness of layers, cm | | | | |
| Floc | 30 | 30 | 50 | 50 |
| Sawdust | 30 | 20 | 20 | 10 |
| Earth | 27 | 37 | 17 | 27 |
| Ratio Sawdust/floc | 1 | 0.67 | 0.4 | 0.2 |
| Starting Consistency | Hard | Hard | Hard | Hard |
| Consistency after 2 days | " | " | " | " |
| after 6 days | " | " | " | " |
| after 22 days | " | " | " | " |
| after 30 days | Soft | " | " | " |
| Settlement, cm | | | | |
| after 6 days | 4 | 3 | 1 | 3 |
| after 22 days | 4 | 3 | 2 | 4 |
| after 30 days | 4 | 4 | 2 | 5 |

It can be seen, by comparison with example 11, that sawdust provided excellent results, particularly for a sawdust-floc ratio of 0.4 in example 3.

EXAMPLE 5

The absorbent material was constituted by sawdust in conjunction with corn refuse compacted 5 times, that is, compressed to one fifth of their volume. The thicknesses of the layers in this case were: floc 30 cm; sawdust 10 cm; compacted corn waste 2 cm; earth 45 cm. The ratio of floc to sawdust + corn waste amounted to 0.4.

The consistency remained hard until the 22nd day; it became soft after one month following the rain mentioned above, as in example 1.

Settlement varied from 2 cm after 2 days to 10 cm after 30 days. Since this settlement was only 7 cm after 3 weeks, it can be considered that the use of sawdust in conjunction with corn waste is nevertheless highly advantageous.

EXAMPLES 6 to 9

The absorbent material tested was constituted by corn waste compacted 5 to 10 times.

| No. | 6 | 7 | 8 | 9 |
|---|---|---|---|---|
| Thickness of layers, cm | | | | |
| Floc | 50 | 30 | 50 | 30 |
| Corn Waste | 1 | 3 | 6 | 7 |
| Earth | 36 | 54 | 31 | 50 |
| Ratio waste/floc | 0.02 | 0.1 | 0.12 | 0.23 |
| Starting consistency | Hard | Hard | Hard | Hard |
| Consistency after 2 days | " | " | " | " |
| after 6 days | " | " | " | " |
| after 22 days | Soft | " | " | " |
| after 30 days | " | Soft | Soft | Soft |
| Settlement, cm | | | | |
| after 2 days | 2 | 2 | 2 | 2 |
| after 6 days | 7 | 8 | 8 | 9 |
| after 22 days | 11 | 14 | 11 | 14 |
| after 30 days | 11 | 14 | 14 | 14 |

Although the results are not as good as with sawdust, there is, nevertheless, definite stabilization of the fill ground of the mud-pit.

EXAMPLE 10

In this example was tested as absorbent material, a mineral substance, namely slag from aluminum manufacture.

On 30 cm of floc was spread 8 cm of slag, which was then covered with 49 cm of earth. The ratio of slag to floc is 0.27.

From the second day on, the ground becomes soft and remains thus for the entire 30 days of the experiment. The settlement if 9 cm after only 2 days and reaches 18 cm after a month.

Aluminum slag, therefore, does not constitute an absorbent material of interest.

EXAMPLE 11

This is the comparative (control) experiment, carried out simultaneously with examples 1 to 10, with no absorbent material Into the drum was put only 50 cm of floc covered with 37 cm of earth. The latter is soft from the start and did not become any firmer. Settlement is 8 cm after 2 days, 15 cm after 3 weeks and 16 cm after a month. Surface water quickly appears, creating a new mud pit.

I claim:

1. Method for the restoration of drilling mud-pits comprising the covering of the floc in a mud-pit with a dry material capable of absorbing water from said floc, and covering said material with earth.

2. Method according to claim 1, in which said absorbent material is a natural cellulosic material.

3. Method according to claim 2, said cellulosic material is sawdust or wood chips.

4. Method according to claim 3, wherein the ratio of the thickness of the layer of absorbent to the thickness of the layer of floc is 0.2 to 1.

5. Method according to claim 2 in which the cellulosic material comprises straw, corn cobs, leaves or stalks.

6. Method according to claim 2, in which said absorbent material comprises cork or peat.

7. Method according to claim 2, wherein the ratio of the thickness of the layer of absorbent to the thickness of the layer of floc is 0.2 to 1.

8. Method according to claim 1, characterized in that the absorbent material comprises chips of foam of polyurethane, polystyrene, polyethylene, or polypropylene.

9. Method according to claim 1, the absorbent material comprising textile or paper waste.

10. Method according to claim 1, characterized in that the quantity of absorbent material is such that it can absorb all of the water from the floc.

11. Method according to claim 10, wherein the quantity of absorbent material is 0.1 to 0.5 kg per kg of water to be eliminated from the mud-pit.

12. Method according to claim 11, wherein the ratio of the thickness of the layer of absorbent to the thickness of the layer of floc is 0.2 to 1.

13. Method according to claim 1, wherein the ratio of the thickness of the layer of absorbent to the thickness of the layer of floc is 0.2 to 1.

14. Method according to claim 11, wherein the ratio of the thickness of the layer of absorbent to the thickness of the layer of floc is close to 0.4.

* * * * *

UNITED STATES PATENT OFFICE

CERTIFICATE OF CORRECTION

Patent No. 4,063,386 Dated December 20, 1977

Inventor(s) Bernard Tramier

It is certified that error appears in the above-identified patent and that said Letters Patent are hereby corrected as shown below:

For the name of the assignee read -- Societe Nationale Elf Aquitaine (Production) --

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*